US007935033B2

(12) United States Patent
Blessing

(10) Patent No.: US 7,935,033 B2
(45) Date of Patent: May 3, 2011

(54) SIMULATED SKI MOTION MACHINE

(76) Inventor: Daniel Joseph Blessing, Cincinnati, OH (US)

( * ) Notice: Subject to any disclaimer, the term of this patent is extended or adjusted under 35 U.S.C. 154(b) by 0 days.

(21) Appl. No.: 12/334,566

(22) Filed: Dec. 15, 2008

(65) Prior Publication Data

US 2009/0176631 A1 Jul. 9, 2009

Related U.S. Application Data

(60) Provisional application No. 61/014,835, filed on Dec. 19, 2007.

(51) Int. Cl.
*A63B 69/18* (2006.01)

(52) U.S. Cl. ..... 482/71; 482/51

(58) Field of Classification Search ..... 482/70, 482/71

See application file for complete search history.

(56) References Cited

U.S. PATENT DOCUMENTS

| | | | | |
|---|---|---|---|---|
| 5,429,567 | A * | 7/1995 | Gerschefske et al. | 482/70 |
| 6,231,484 | B1 * | 5/2001 | Gordon | 482/71 |
| 2006/0189454 | A1 * | 8/2006 | Bull | 482/71 |
| 2006/0247105 | A1 * | 11/2006 | Baydzhanov | 482/71 |

* cited by examiner

*Primary Examiner* — Loan Thanh
*Assistant Examiner* — Shila Abyaneh

(57) ABSTRACT

Ski simulation device has at least two arching rails parallel each other on a sloped plane elevated at an angle of a variable degree, joined to frame structure which includes handgrip and cross rail, arching rails providing track; a carriage rides in side-to-side movement on track; whereas carriage on which platform is mounted around axis, whereas platform on which two cradles each is mounted around its axis, whereas cradles wherein two rocking footrests are nested; resistance members providing a constraint on carriage as it rides on track; dampening member extending from front section of frame structure joined to midpoint on transverse bar of which ends joined to cradles; an assembly of rollers mounted on frontal sides of both cradles, whereby rollers as guide roll on cross rail; and rod extending from front section of frame structure to a point where mounted ball can be reached by user's both knees.

5 Claims, 13 Drawing Sheets

SIMULATED SKI MOTION MACHINE

CROSS-REFERENCE TO RELATED APPLICATIONS

The present application claims priority in part application of application Ser. No. 61/014,835, filed Dec. 19, 2007.

FEDERALLY SPONSORED RESEARCH

Not applicable

BACKGROUND OF THE INVENTION

1. Field of the Invention

This invention relates generally to skiing simulation devices and, more particularly, to training and exercising equipment for simulating muscle and aerobic activity during skiing, such as Alpine and downhill skiing. Skiing is often referred to as a non-instinctive sport. Accordingly, the advancement of skiing skills involves a continuous repetition of proper form. Because most geographic areas have a short season wherein skiing is available, and because it is time consuming and expensive to ski at most ski slopes even during the skiing season when skiing is available, there has been, and prior to the instant invention, remained an unfulfilled need for a moderately priced device that allows skiers to properly prepare for skiing off of the ski slopes—such as (a) at indoor skiing classes, (b) at recreational centers, and (c) at home.

2. Related Art

A few skiing simulation devices are known in the art. However, these few machines are very limited and don't properly permit simulation of alpine or downhill skiing. In general, these devices are mostly focused on providing an aerobic exercise rather than improving skiing skills. As an example, some of the other devices incorporate a large resilient band to facilitate motion in that greatly distracts from realistic skiing simulation.

The most relevant patents were U.S. Pat. No. 5,749,811 and U.S. Pat. No. 7,090,621

BRIEF SUMMARY OF THE INVENTION

In view of the unfulfilled need for an accurate downhill skiing simulation device and in view of the limitations in the existing devices, the present, ski sensation, high accuracy, ski simulation device was developed.

A primary object of this invention is to provide a skiing simulation device for more accurately simulating the motions performed during skiing conditions. Another object of this invention is to provide such a skiing simulation device that is appropriate for a broad range of skier's—from the expert skier to the beginner skier, or novice. Another object of this invention is to provide an exercise device for accurately simulating muscle, aerobic, and balancing activities during such skiing conditions.

Simulated Ski Motion Machine has a frame structure including rails, a pair or foot vehicle of which various layered panels revolving independently around axis above a carriage, a roller guide on which the foot vehicle rolls for direction and guidance, a dampening member inducing the foot vehicle to align the member via transverse bar that joins to footrests atop the foot vehicle, handrail tilting for slippery effects, and roller guide moving away for workout with or without poles, and resistance members being used to propel carriage to centers of rails.

One aspect of the invention, a ski simulation device includes an air cylinder of which one end is mounted on a front section of said frame structure and the other end mounted on said transverse bar that is relative to said foot vehicle. A further aspect of the invention, there is an assembly of rollers that is mounted on frontal sides of cradles wherein footsteps are nested. Another aspect of the invention is a platform rotates around an axis just as the footrests rotate counterclockwise and clockwise and swing simultaneously.

The present device, unlike the other related devices, allows simulation of most of the essential motions in skiing including downhill and Alpine skiing. The present invention enables one to obtain (a) technique training, (b) aerobic exercise, (c) specific muscle strengthening/training, and (d) balance exercise/training—all while having fun and exercise in practicing skiing. Thus, the present invention can be used to provide a program sufficient to maintain the interest and enthusiasm of even an advanced skier.

The present device achieves a realistic skiing simulation in a relatively simple and inexpensive mechanism. The structure of the present design can provide a freedom of action and movement that encourages proper form, but not forcing form. The present invention maintains a balance between the machine's ease of use for lower skill levels while allowing for the implementation of more advanced skills. The present device's forgiving realistic simulation helps skiers identify and develop areas in their form that may need improvement.

The broad range of motions available on the present device makes it an ideal trainer/exerciser simulator for all levels of ability. From those who have never skied to black diamond experts, this device facilitates progressive advancement to higher levels of skill and technique. Even further, this device could also greatly assist training of blind skiers. For example, a reachable height of the footrests was considered and developed for their use.

The skier and gravity, as in actual skiing, drive the present device and not a combination of the skier and a large resilient band as found in other devices. This translates into a much greater control for the skier over the type and timing of turns, etc. The skier is able to hold a position, or turn, for however long he desires to. As a result, this not only provides for the possibility of mixing different types of turns, but it also allows the skier time to concentrate fully on technique, positioning, and action. The skier does not have to concentrate on responding to contraction of an outstretched resilient band. And the skier does not have to strengthen muscles to learn ski techniques. A ski apparatus is originally designed to serve a specific function of which body parts are developed. A ski simulation device is known for something designed to achieve a particular effect that is skiing. Such as apparatus and devices have its limitations of use. Special features in the present device filled further missing gaps.

One of these novel features is an assembly of rollers mounted on frontal sides of the cradles so that they roll securely on the roller guide. A dampening member is secured at a pivot point of foot vehicle and the said cradles are aligned with the pivot point at bay of frame structure. The said foot vehicle rides on track. These properties allow a novice skier to focus on proper ski movements. This helps the beginner to recognize development in body parts when performing various routines. The developed body parts sense the ski movements as if on a slope. It is an automation machine that helps to replace ski instructors.

A strenuous exercise can be done when the roller guide is separated from the rollers. when resistance, not resilient, members induce the carriage to propel to centers of the rails. The cradles wherein the versatile footrests are nested would move backward and forward at will. The handgrip would be not be used when the expert use his or her own ski poles.

The other feature on the present device is an air cylinder mounted to induce the cradles pivoted at foot vehicle to align with the air cylinder via said transverse bar. It also dampens and absorbs vibrations and shocks on foot vehicle. The beginner can focus on techniques needed for skiing. Anything that distorts a thought would misguide the beginner into thinking that it happened on a slope, too. The present device is intently and strictly engineered for quiet performance even at all joints of motion in such invention.

The present inventor is physically deaf and he is familiar with sound barriers, vibrations, and noise creations. Consequently, the considerations of those improvements to the device were given in such invention.

As a teaching tool, the present device is ideal for beginners and experienced skiers, alike. It is as equally proficient in helping new skiers begin to develop a feel for skiing, and in learning the important basic fundamentals required on the slopes, as it is in helping experienced skiers improve and strengthen their form, providing all levels a greater enjoyment and confidence on the slope.

BRIEF DESCRIPTION OF SEVERAL VIEWS OF THE DRAWINGS

FIG. 1 C shows details of how foot vehicle 22 is affixed to frame of the device 10.

DETAILED DESCRIPTION OF THE INVENTION

Figure 1:
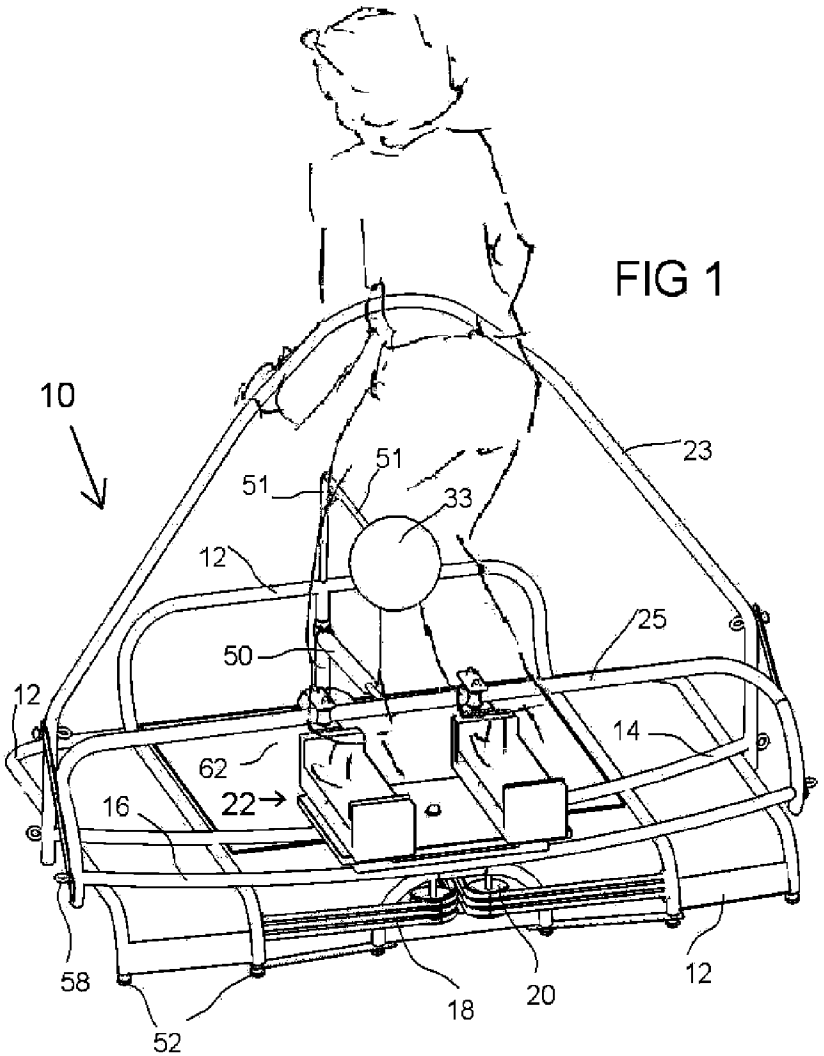
FIG. 1 illustrates an elevated rear view of the device.
Figure 6:
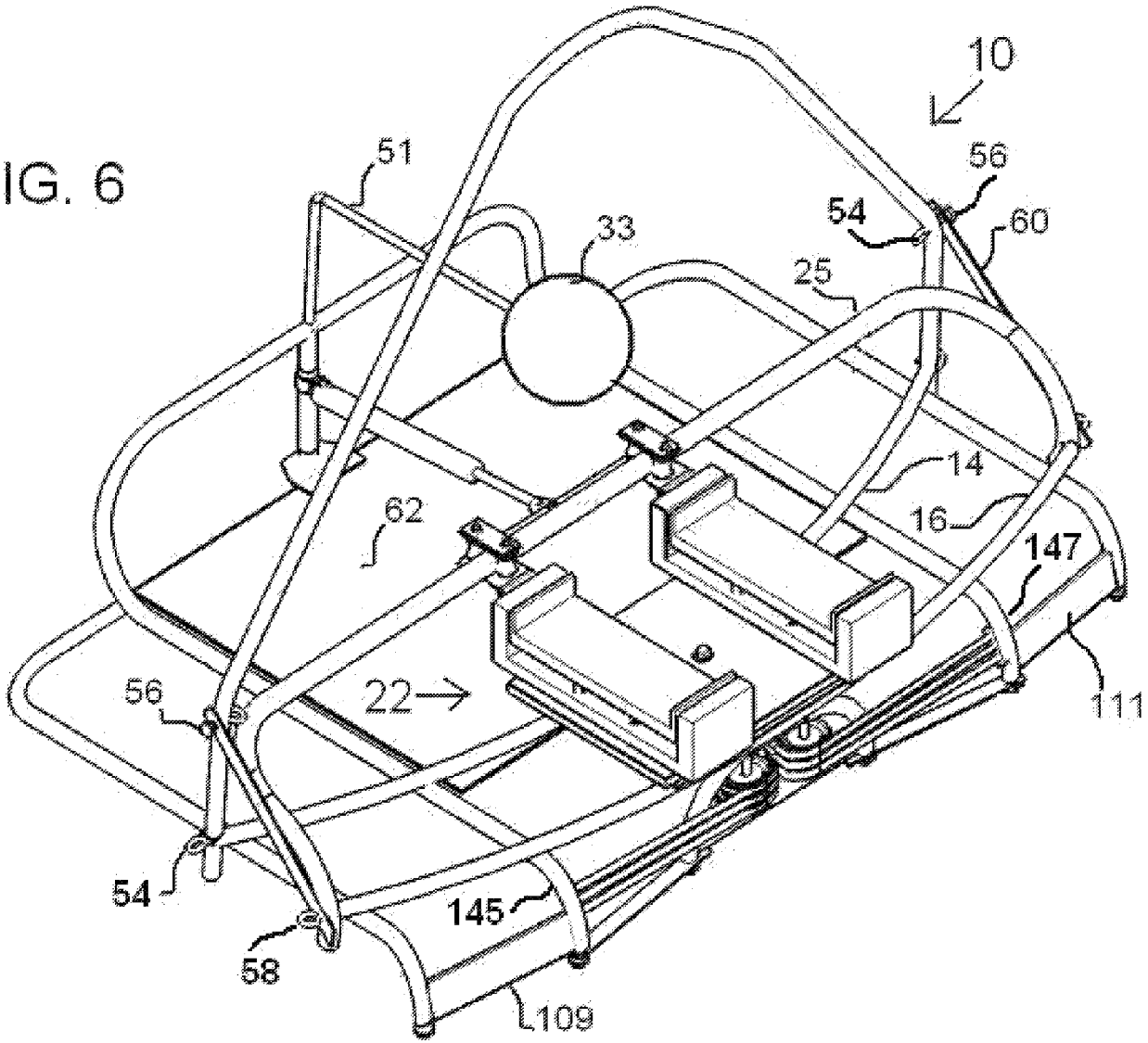
FIG. 6 illustrates a plan view of the device of the invention.
Figure 7:
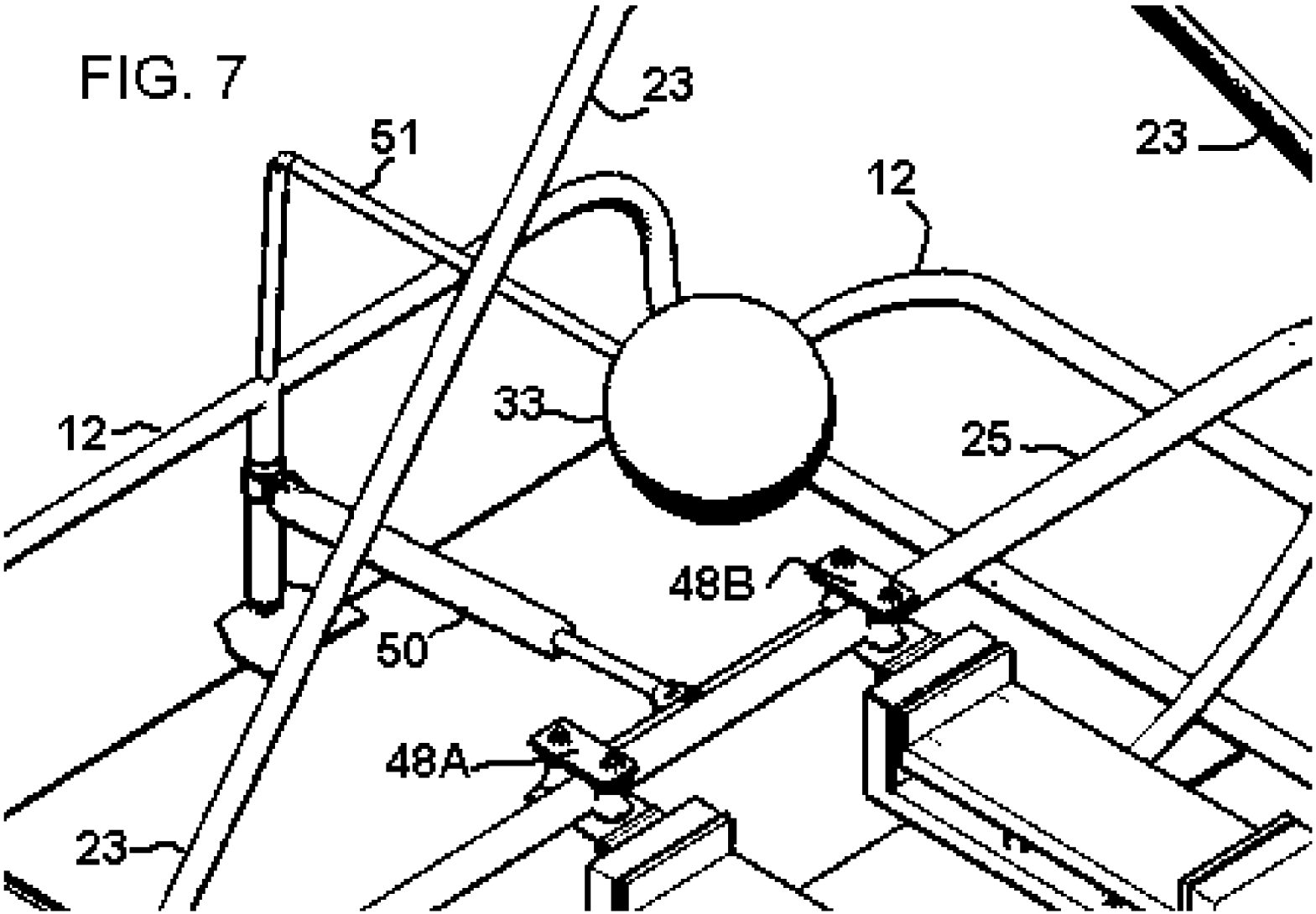
FIG. 7 is close-up left rear view of part of invention.

FIG. 1 and FIG. 6 illustrate the invention, ski simulation device 10. The device is used by a skier to develop his body parts for skiing and to train general users for basic techniques needed to ski properly. The device 10 comprises a skeletal frame structure 12, a set of two segmented, a pair of paralleled rails 14 and 16 on an elevated section of the frame structure 12, a foot vehicle 22 sitting on centers of the rails 14 and 16, respectively in FIG. 1.

Figure 1A:
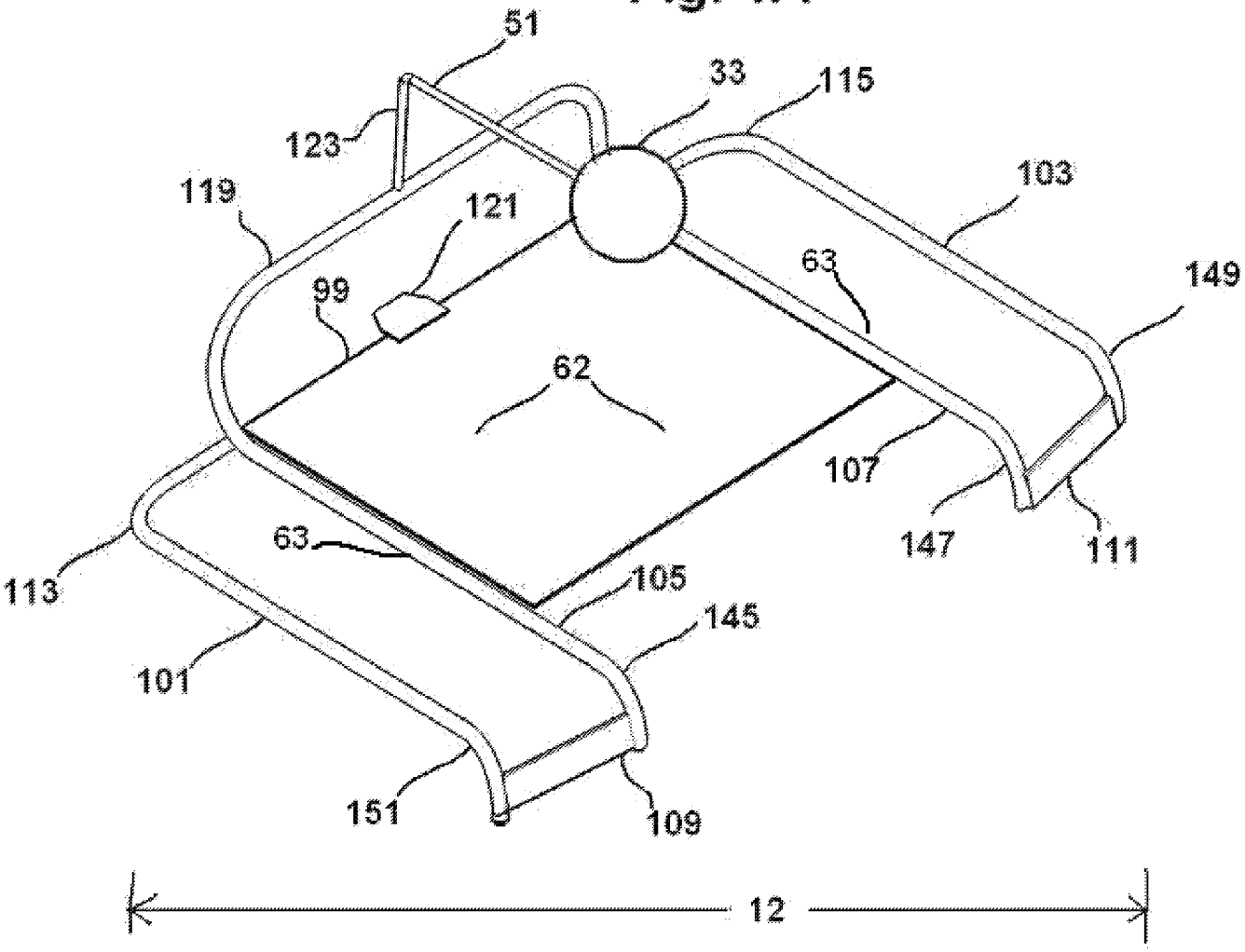
FIG. 1A shows in uncluttered view skeletal frame structure 12.
Figure 1B:
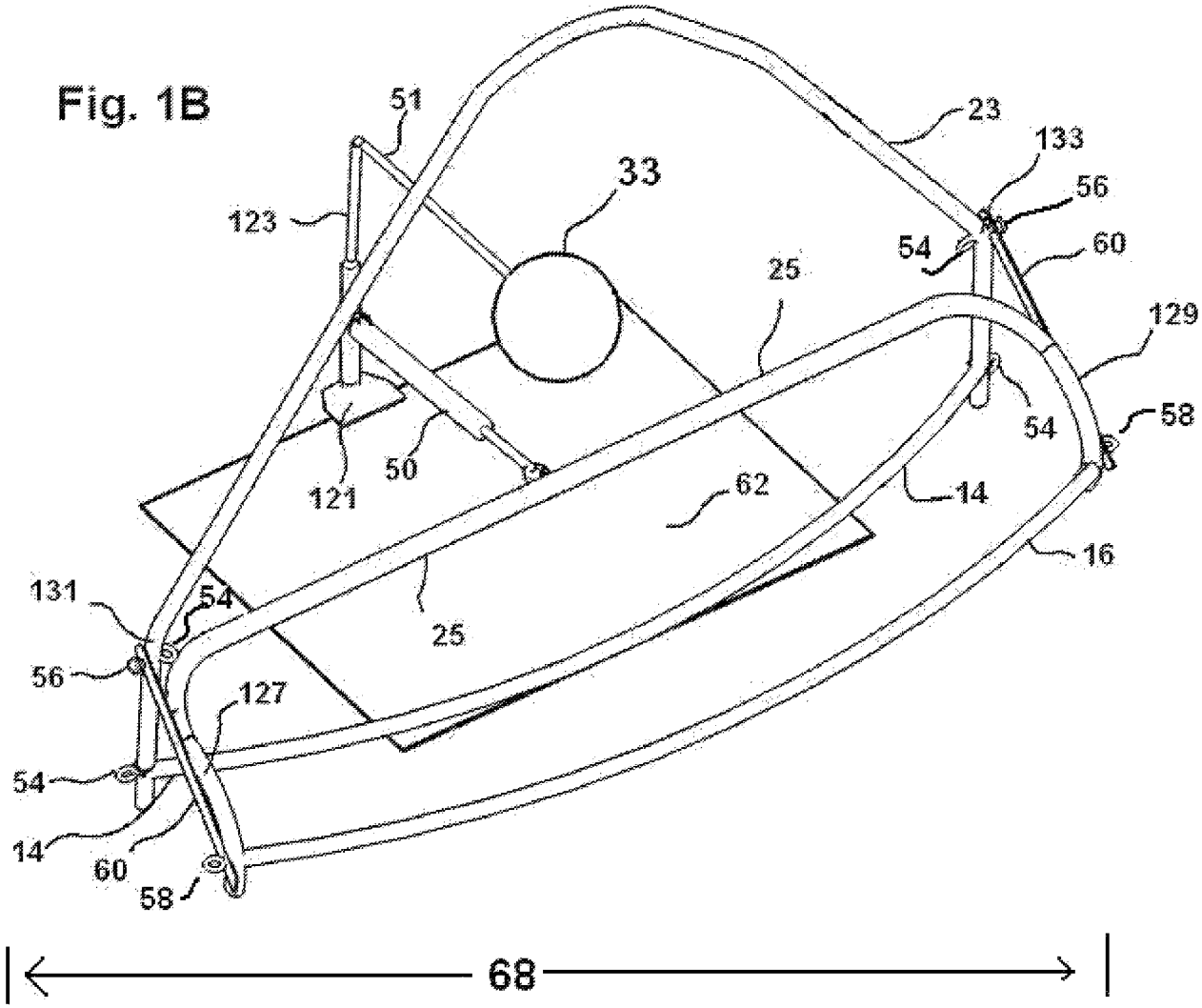
FIG. 1B illustrates the placement of the skiing device on the skeletal frame structure 12
Figure 1C:
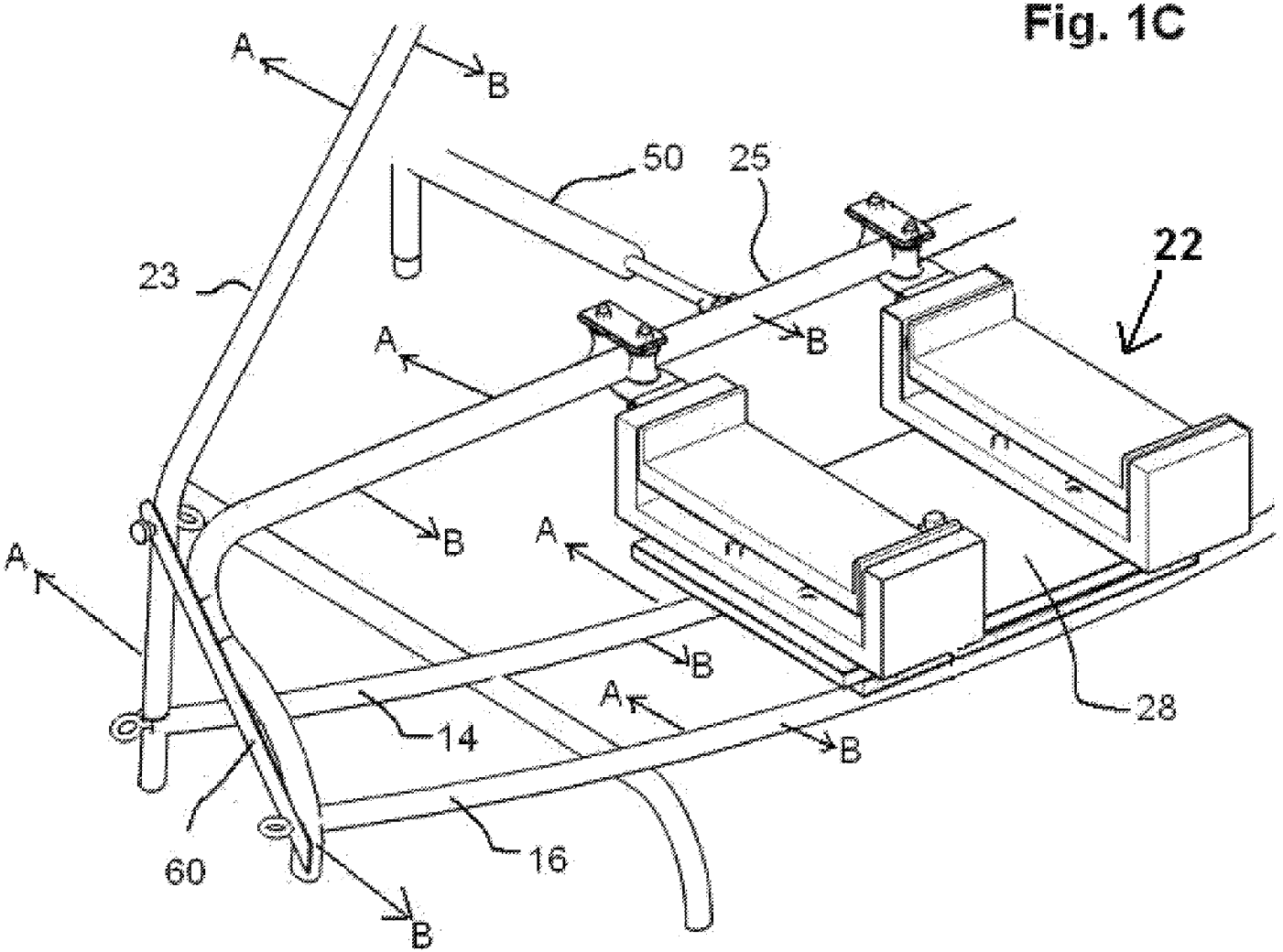

FIG. 1A shows skeletal frame structure 12. Skeletal frame structure 12 is constructed with left outer support pipe 101 and right outer support pipe 103 and left inner support pipe 105 and right inner support pipe 107. Left support rectangle 109 connects left outer support pipe 101 with left inner support pipe 105. Right support rectangle 111 connects right outer support pipe 103 with right inner support pipe 107.

Left outer support pipe 101 continues rearward in left outer curve 113 to connect to non-breakage sheet 62. Right outer support pipe 103 continues rearward in right outer curve 115 which connect to right side of non-breakage sheet 62. Left inner support pipe 105 curves rearward and upward and terminates as left end of support duct 119. Right inner support pipe 107 curves rearward and upward and ends on right side of support duct 119.

At center rear of non-breakage sheet 62 is attached base 121 for training ball 33. Base ball support 123 is attached to center of support duct 119 and is inwardly turned to become flexible rod 51. Training ball 33 is affixed to the end of a flexible rod 51.

FIG. 1 B illustrates the placement of that portion of the skiing device on the skeletal frame structure 12 as connected via the non-breakage sheet 62 which is attached base for training ball 33. Base ball support 123 is attached to center of support duct 119 and is inwardly turned to become flexible rod 51. Training ball 33 is affixed to the end of a flexible rod 51.

A pair of paralleled rails 14,16 with downwardly curved outermost rail 16 and downwardly curved innermost rail 14 are placed on an elevated section that is left inner support pipe 105 and right inner support pipe 107 of the frame structure 12. Innermost rail 14 and outermost rail 16 are mechanically affixes and moveably affixed to arching handrail 23 with a left bent 131 and a right bend 133. Arching handrail 23 with a left bent 131 and a right bend 133 is movably affixed with rope loop bolts 54 to the respective ends of rear rail 14. Both ends of outermost rail 16 are movably affixed via front rope loop bolts 58 to right and left bent ends of roller guide 25. Arching handrail 23 has curved ends on each terminus that is affixed to the front rail 16 via front rope loop bolts 58. Guy bars 60 are affixed to both ends of front rail 16 and in turn affixed to arching handrail 23 left bent 131 and a right bend 133 with a set of knobs 56.

FIG. 1 C shows details of how foot vehicle 22 is affixed to frame of the device 10. Foot vehicles 22 is movably affixed to roller guide 25 by a set of rollers 44A and 44B, and a set of short bars 46A and 46B to provide mechanical affixion of the innermost rail 14 and outermost rail 16 Foot vehicles 22 are urged to centers of curved outermost rail by roller guide 25 affixed to air cylinder 50. Air cylinder 50 is attached to generally mid point of ball support 123. Foot vehicles 22 are connected together by revolving platform 28 Friction-reducing member 26 being sandwiched between the carriage 24 and the revolving platform 28.

Figure 2:
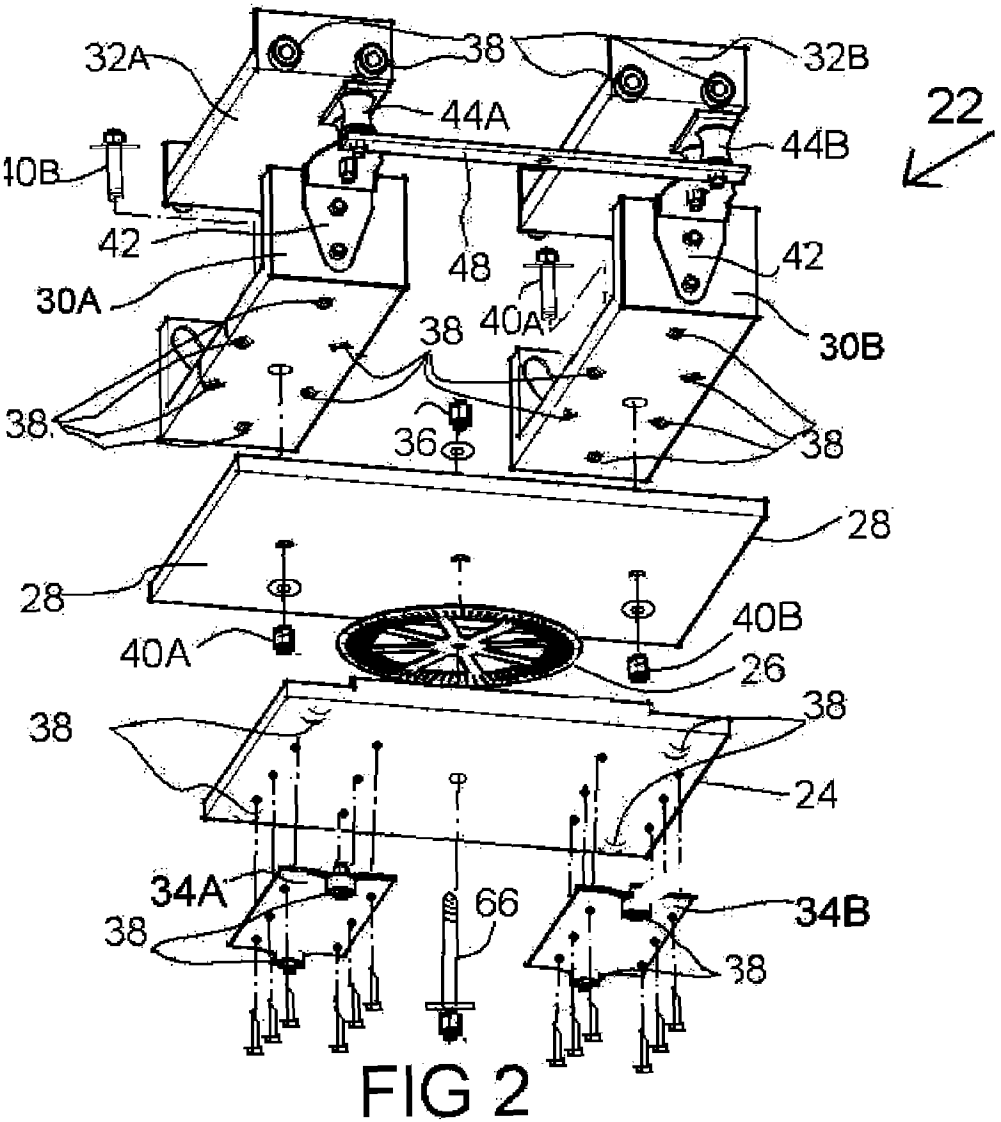
FIG. 2 illustrates an exploded view of the below foot vehicle of the device.
Figure 3:
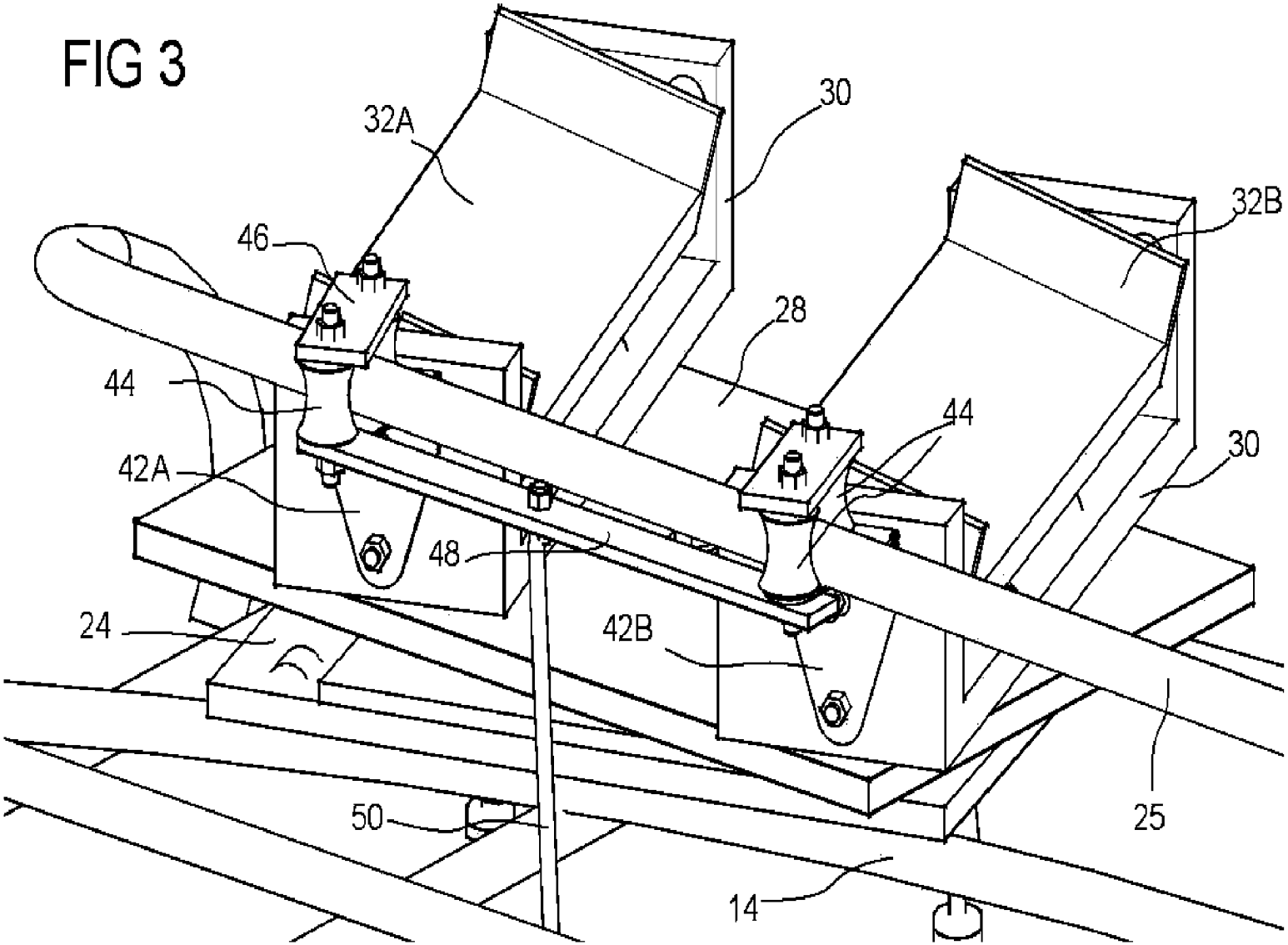
FIG. 3 illuminates a set of footrests 32A and 32B tilting laterally.
Figure 5:
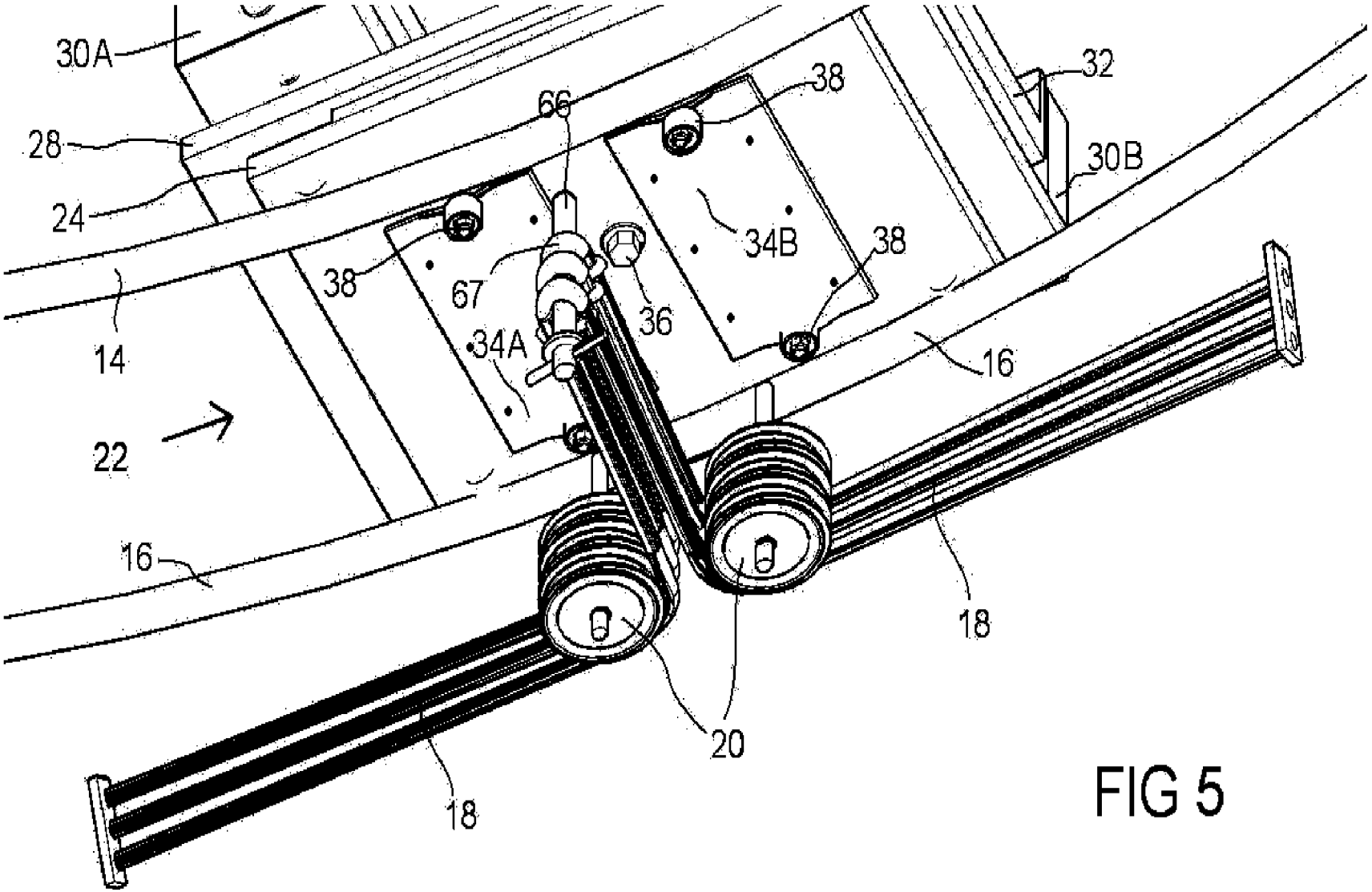
FIG. 5 illuminates how an assembly of the resistance members is secured.

FIG. 3 shows foot vehicle 22 comprises a carriage 24, a revolving platform 28 swiveling over the carriage 24 through which a long pivot bolt 66 is driven, a pair of cradles 30A and 30B each swiveling over the revolving platform 28, a set of small friction-reducing wheels 38 inserted in the undersides of the cradles 30A and 30B through which a pair of short pivot bolts 40A and 40B is driven, and a pair of footrests 32A and 32B nested in the cradles 30A and 30B swinging laterally;

A set of bridge plates 34 with a pair of small friction-reducing wheels 38 affixed to them, shown in FIG. 2 and FIG. 5, joined to the underside of the carriage 28, being used for skating securely against edges between the paralleled rails 14 and 16, respectively in FIG. 1.

As illustrated in FIG. 5 the wheels are rolling on the rails near its undersides, whereas the contacts between the wheels and the rails stay intact, not a chance of slipping over the rails. The rails 14 and 16 would be manufactured for the wheels 38 to snap in.

Figure 8:
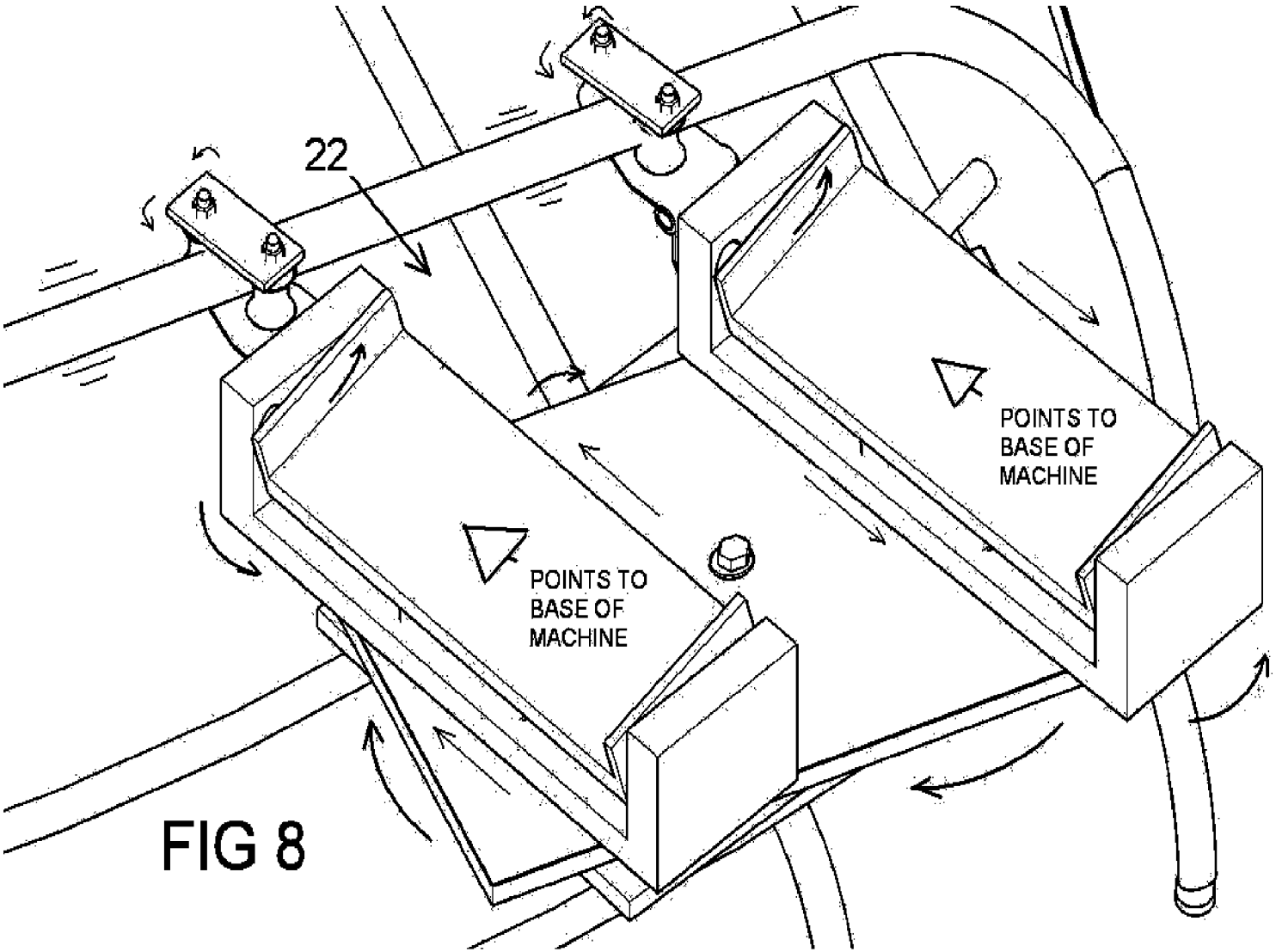
FIG. 8 illuminates line directions of the part movements of the foot vehicle 22.
Figure 10:
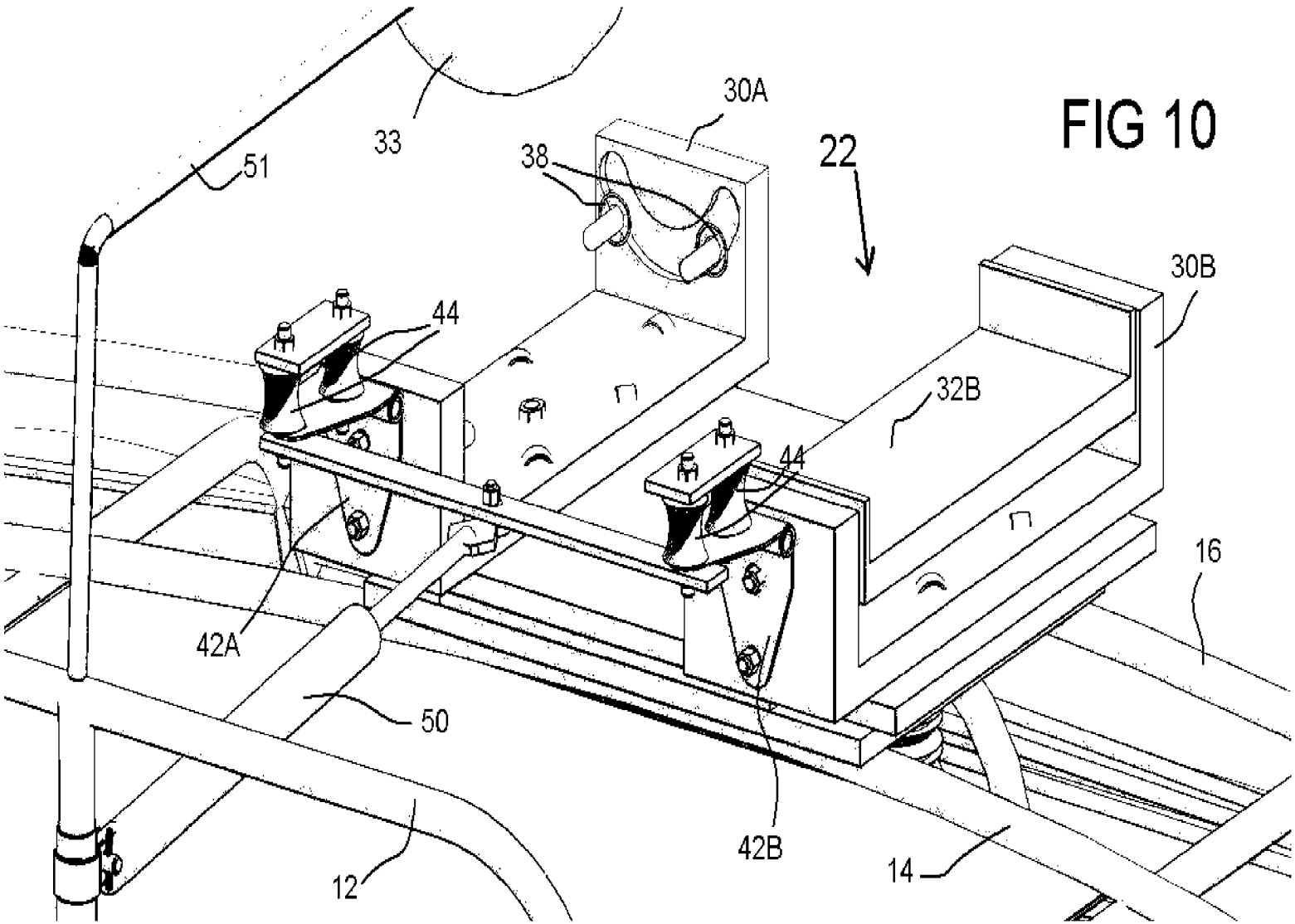
FIG. 10 describes parts used on footrests 32B.

A friction-reducing member 26 being sandwiched between the carriage 24 and the revolving platform 28 that spins around the carriage 24, respectively in FIG. 2;

The cradles 30 with friction-reducing wheels 38 inserted in the undersides of the cradles 30 through which a pair of the small pivot bolts 40 driven, each rotating side by side atop platform 28 in FIG. 2. The footrests 32A and 32B with friction-reducing wheels 38 affixed to its fore and aft ends, nested in the cradles 30A and 30B, each tilting laterally as illustrated in FIG. 3 and FIG. 8. These nested sets moving in opposite directions in line with the air cylinder alternatively and interactively as shown in FIG. 8 and FIG. 10;

The user is learning a change in the foot positions when they are in opposite directions at a turning point around the ends of the rails, as actual turning at a corner on a ski slope. The illustration FIG. 8 embodies these functions described above.

A set of roller assemblies for the two cradles comprising a set of hinges 42A and 42B, roller guide 25 a set of rollers 44A and 44B, and a set of short bars 46A and 46B. These assemblies affixed to the frontal cradles 30A and 30B positioning the rollers 44A and 44B onto the roller guide 25 in FIG. 3.

The rollers 44A and 44B together rolling securely against the sides of the roller guide 25 as shown in FIG. 3, wherein the rollers 44A and 44B guiding the foot vehicle 22 in FIG. 3.

Figure 4:
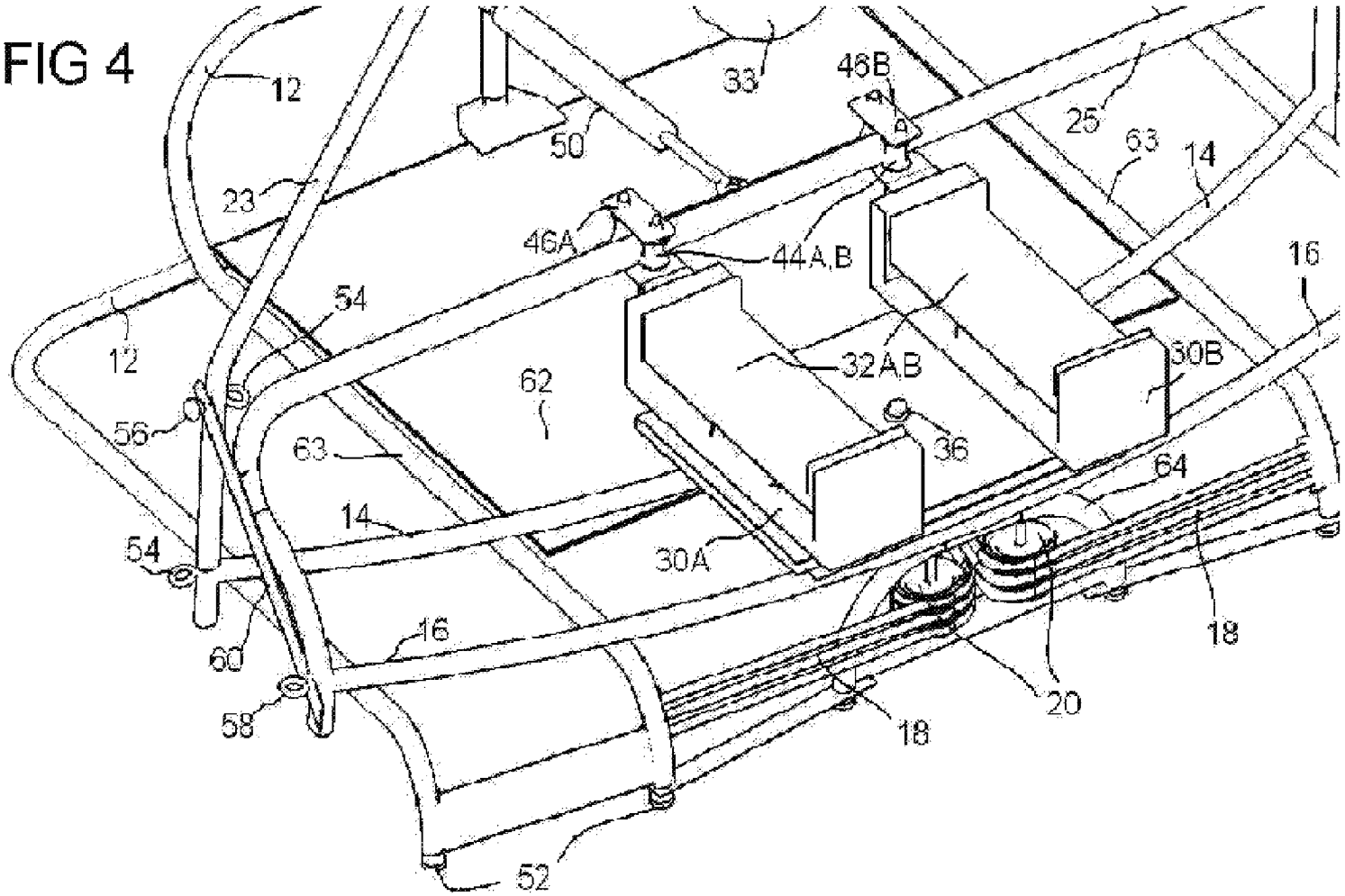
FIG. 4 illustrates a left rear view of the device.

As illustrated in FIG. 3 and FIG. 8 the roller guide 25 acts as a guide of the foot vehicle on which the user stands, manipulating the movements of the foot vehicle along the roller guide 25. The transverse bar 48, with its ends joining to the upper ends of the hinges 42A and 42B, thus harnessing the foot vehicle 22, via the air cylinder 50 in FIG. 3;

The air cylinder 50, impending from the front section of the frame structure 12, connecting to the transverse bar 48 on its midpoint, thus harnessing the foot vehicle 22 shown in FIGS. 2, 3 and 4. As illustrated in FIG. 3 the air cylinder 50 in FIG. 10 acts on the movements of the foot vehicle 22, sensing shocks and vibrations and directing ski directions and advising on snow conditions and adding new experiences as the user collects from using the device frequently.

A training ball 33, affixed to the end of a flexible rod 51 that extends from the front section of the frame structure 12, when necessary, positioned behind the user's knees in FIG. 1.

The training ball 33 keeping knees close together, as actual turning at a corner on a ski slope, also making the user's knees bend for exercising his or her lower body.

Figure 9:
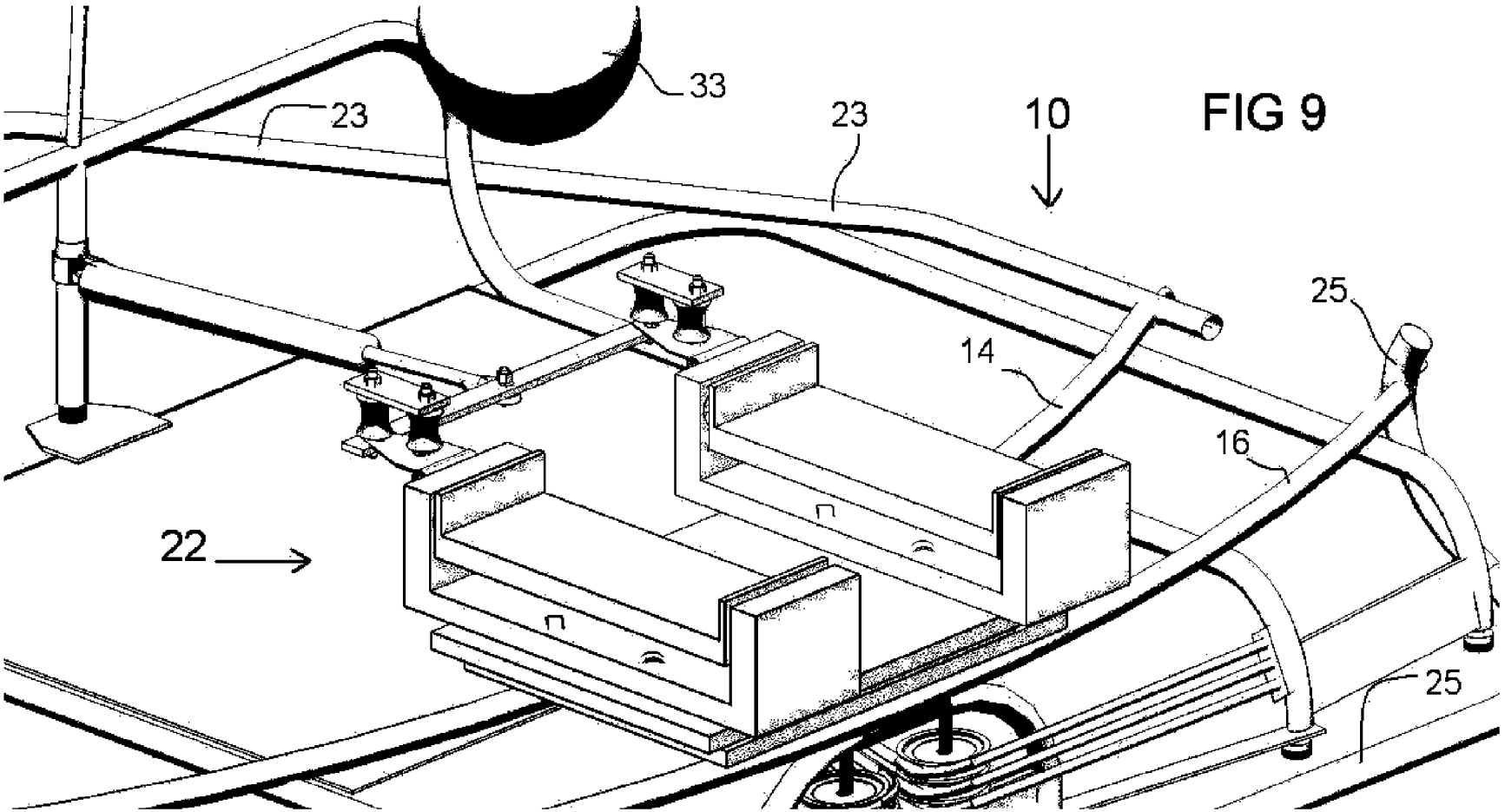
FIG. 9 embodies the claimed parts of the device of the invention.

A set of adjustment levelers 52 leveling the frame structure 12, shown in FIG. 1 and FIG. 4, when established for performance.

set of rear rope loop bolts 54, a set of knobs 56, and a set of front belt loop bolts 58 securing an arching handrail 23 via a set of guy bars 60 and the innermost and outermost rails 14 and 16, respectively in FIG. 4;

As illustrated in FIG. 9 the arching handrail 23 and the roller guide 25 moving away when the user needs to have a good workout, after removing the rope loop bolts 54 and the belt loop bolts 58 on them, respectively in FIG. 4;

The belt loop bolts 58 affixed to the ends of the outermost rail 16 being a pole holder as shown in FIG. 4;

A non-breakage sheet 62, with its edges affixed to the middle tubes 63 of the frame structure 12 in FIG. 1 and FIG. 4, thus securing the frame structure 12;

An arcuate holder 64 propping the outermost rail 16 and positioning the pulleys 20 on which the resistance members 18 relies for providing a constraint on the foot vehicle in FIG. 4;

The long pivot bolt 66, affixed to the underside of the carriage 24 in FIGS. 2 and 5, around which a fastening means 67 secures the resistance members 18 on its midpoint, its ends being affixed to the outermost leg next to the arcuate holder of the frame structure 12 in FIG. 5;

The resistance members 18 providing a restoring force, propelling the foot vehicle 22 back to the centers of the rails 14 and 16 in FIG. 1.

While the invention has been described in detail by specific reference to preferred embodiments thereof, it is understood that variations and modifications may be made without departing from the true spirit and scope of the invention.

What is claimed is:

1. A skiing simulation device comprising:

a skeletal frame structure;

a roller guide assembly;

a foot vehicle;

said skeletal frame structure is constructed with a left outer support pipe with a left front down curve and a right outer support pipe with a right front down curve;

a left inner support pipe with a left inner base curve;

a right inner support pipe with a right inner base curve;

said left front down curve uses a left support rectangle to connect with said left inner base curve;

said right front down curve uses a right support rectangle to connect with said right inner base curve;

said left inner support pipe curves rearward and upward and terminates on left end side of a support duct;

said right inner support pipe curves rearward and upward and terminates on right end side of said support duct;

said left outer support pipe has a rear left angle inward curve that terminates on left rear of a non-breakage sheet;

said right outer support pipe has a rear right angle inward curve that terminates on right rear of said non-breakage sheet;

at center rear edge of said non-breakage sheet, between said inward curve of said left outer support pipe and said inward curve of said right outer support pipe is an attached base for connecting a training ball;

said attached base is upwardly affixed to a base training support which is attached to the center of said support duct and is inwardly turned forward to become a flexible rod;

said training ball is affixed to the end of said flexible rod;

said roller guide assembly has an outermost downwardly bowed rail and an innermost downwardly bowed rail which are movably placed on said left inner support pipe and said right inner support pipe;

said roller guide assembly further comprising an arching handrail with a left bend at left terminal end and a right bend at right terminal end;

said terminal ends of said arching handrail are movably affixed with a pair of rope loop bolts to respective left and right ends of said downwardly bowed innermost rail;

said roller guide assembly further comprising a central section of which is a roller guide;

curved ends of said roller guide are movably affixed with a pair of belt loop bolts and a pair of guy bars to respective left and right ends of said downwardly bowed outermost rail;

wherein the other ends of said pair of guy bars are movably affixed via said pair of rope loop bolts with a pair of knobs to said bends at said terminal ends of said arching handrail, respectively; Said foot vehicle comprising a carriage;

affixed to the underside of said carriage is a pair of right and left bridge plates with a pair of small friction-reducing wheels affixed to said right and said left bridge plates;

a friction-reducing member is placed between a revolving platform and said carriage; said revolving platform is located on top of said carriage;

wherein a set of said small friction-reducing wheels are inserted in the undersides of a pair of cradles, wherein said pair of cradles are rotationally affixed atop of said revolving platform via small pivot bolts;

wherein fronts of said pair of cradles of said foot vehicle are movably affixed to said roller guide by a right set of rollers and a left set of rollers, wherein said right set of rollers are connected to each other via a right short bar and said left set of rollers are connected to each other via a left short bar;

said foot vehicle movably rests on said downwardly bowed innermost rail and said downwardly bowed outermost rail with said pair of small friction-reducing wheels which are affixed to said left and said right bridge plates;

wherein gravity urges said foot vehicle to centers of said downwardly bowed outermost rail and said downwardly bowed innermost rail;

said right set of rollers is being hinged and connected to said left set of rollers via a transverse bar; wherein the ends of said transverse bar are joining upper ends of a right hinge and a left hinge that are affixed to said fronts of said pair of cradles, respectively, thus harnessing said foot vehicle via an air cylinder attached at one end to a midpoint of said transverse bar;

wherein said air cylinder is attached at the opposite end to a midpoint of said base training support.

2. A skiing simulation device as in claim 1, wherein said foot vehicle is additionally urged to the centers of said downwardly bowed outermost rail and said downwardly bowed innermost rail by resistance members attached at one end to a long pivot bolt affixed to the underside of said carriage;

said resistance members pass over left and right pulleys that are affixed to an arcuate pulley holder and affixed at the ends to said left inner base curve and said right inner base curve respectively.

3. A skiing simulation device as in claim 2, wherein ends of said left inner base curve, said right inner base curve, said left front down curve, said right front down curve and both ends of said arcuate pulley holder have adjustment levelers.

4. A skiing simulation device as in claim 1, Wherein said foot vehicle further comprising:

a pair of wide U-shaped cradles each swiveling over said revolving platform, wherein said set of small friction-reducing wheels inserted in the undersides of said pair of cradles through short pivot bolts, wherein said short pivot bolts are placed through holes in said revolving platform; and a footrest nested in each of said pair of cradles swinging laterally.

5. A skiing simulation device as in claim 1, wherein said right set of rollers and said left set of rollers with said right short bar and said left bar are detachable from said roller guide.

* * * * *